United States Patent [19]

Betschart

[11] 4,246,846

[45] Jan. 27, 1981

[54] DOWNHILL SLEDDING SYSTEM

[76] Inventor: Alois J. Betschart, P.O. Box 10977, Zephyr Cove, Nev. 89448

[21] Appl. No.: 907,600

[22] Filed: May 19, 1978

[51] Int. Cl.[3] ..... A63G 21/04

[52] U.S. Cl. ..... 104/69; 104/119; 104/134; 188/8; 188/42

[58] Field of Search ..... 104/53, 59, 63, 64, 104/69, 118, 119, 120, 134; 188/8, 42, 43; 280/11, 12 R, 12 AA, 12 AB, 18; 272/56.5 R, 56.5 SS

[56] References Cited

U.S. PATENT DOCUMENTS

| | | | |
|---|---|---|---|
| 252,918 | 1/1882 | Wilson | 104/134 |
| 780,049 | 1/1905 | Maguire | 104/134 X |
| 3,973,785 | 8/1976 | Becker et al. | 280/11 |

FOREIGN PATENT DOCUMENTS

| | | | |
|---|---|---|---|
| 2150245 | 4/1973 | Fed. Rep. of Germany | 188/43 |
| 2515994 | 10/1976 | Fed. Rep. of Germany | 272/56.5 R |

*Primary Examiner*—Randolph A. Reese
*Attorney, Agent, or Firm*—Flehr, Hobbach, Test, Albritton & Herbert

[57] ABSTRACT

A sledding system having a track installed on a ski slope in the summer has U-shaped track sections with a flat bottom and substantially upright sides which serve to retain a driver controlled sled sliding on the track. Braking is provided by extendable side brakes which engage the upright sides.

12 Claims, 5 Drawing Figures

DOWNHILL SLEDDING SYSTEM

BACKGROUND OF THE INVENTION

The present invention is directed to a downhill sledding system and more specifically to a system which is utilized in the summer where a track is installed on the ski slope and a driver controlled sled is ridden down the track.

A sledding system as above is disclosed in U.S. Pat. No. 3,858,517, issued Jan. 7, 1975 and assigned to Demag Company of Germany. That patent discloses a concave shaped track meandering down a mountain side and a sled which slidably engages the track on slide elements mounted on the sled. The sled includes a seat for the driver and a lever which when actuated engages a centrally located brake to make braking contact with the bottom of the track under the sled.

Another type of sled now being used by Alpine Slide Corporation of Manchester Center, Vermont uses track sections similar to that shown in the Demag patent but has a modified sled. Specifically, the sled rides on four low friction plastic pads, two located near the front of the sled and two located near the rear. In addition, there are four braking pads located fore and aft of the driver's seat and a pair of wheels located in front of the front pair of braking pads. A centrally located control lever has three positions. In a neutral position the sled glides on its four gliding pads. In a forward position the wheels are extended partially disengaging the gliding pads in order to allow the sled to accelerate. Finally, in a pulled back position the lever, of course, retracts the wheels since it has gone through its neutral position and the four brake pads are extended down toward the bottom of the track for slowing the sled. U.S. Pat. No. 3,973,785, assigned to Demag illustrates the foregoing.

A somewhat similar sled as the Alpine slide is shown in a Wiegand German patent publication No. 2,515,994 dated Oct. 21, 1976.

Yet another sledding system is shown in U.S. Pat. No. 3,908,556 in the name of R. Stuhmer dated Sept. 30, 1965 and entitled "Sledding System". This patent in essence discloses a simulated bobsled track, since the sled is substantially similar thereto, where the track has lateral side barriers.

With all of the above foregoing systems the thrill of the downhill ride is, of course, enhanced by more curves at higher speeds. With a concave track it is apparent that, as in a bobsled run, some sleds will veer off the track while under the control of an inexperienced driver. In addition, even if this is not the case after a curve is rounded a sled may have a feeling of instability.

OBJECTS AND SUMMARY OF THE INVENTION

It is, therefore, a general object of the present invention to provide an improved downhill sledding system.

It is a more specific object to provide a sledding system which has improved stability especially on curves and more effective braking.

It is another object of the invention to provide a sledding system as above which allows a driver to exercise a greater range of control to enhance the thrill of the ride.

In accordance with the above objects there is provided a sledding system with a track which includes a plurality of joined U-shaped sections and defining a path for a sled. The bight of the U-shaped section provides a substantially flat sledding surface and the upright sides of the U-shaped section provide a pair of sled retaining and braking surfaces. At least one sled has glide elements for engaging the sledding surface and has selectively engageable braking means extendable from the sides of the sled for frictionally engaging the braking surfaces in a wedging manner.

DETAILED DESCRIPTION OF THE PREFERRED EMBODIMENT

Figure 1:
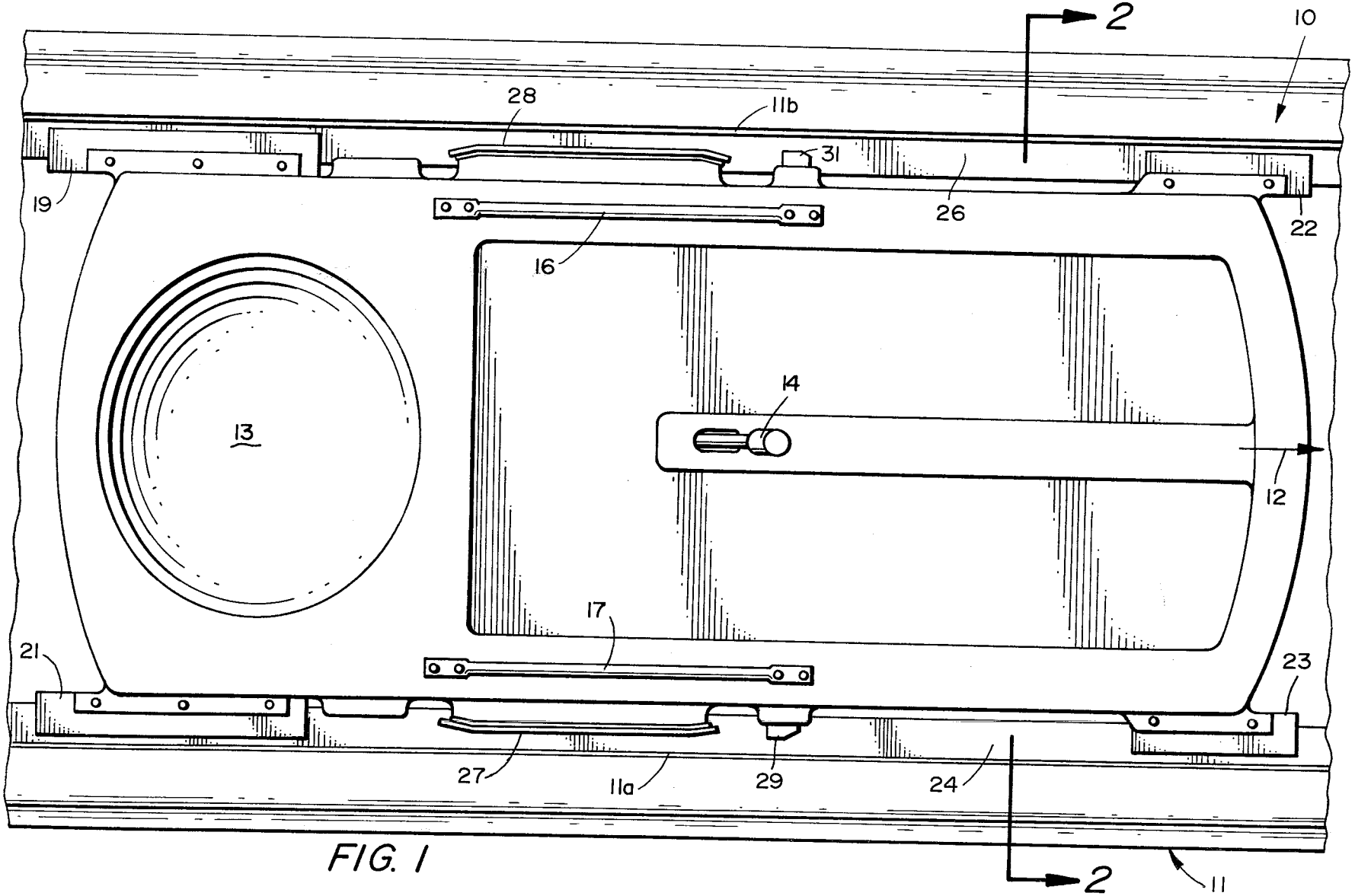
FIG. 1 is a top view of a sled on a track portion embodying the present invention.

FIG. 1 illustrates a sled 10 as it would slide in the U-shaped track section 11 with the arrow 12 indicating the downhill direction. Track section 11 would, of course, be a portion of a long curving track down a mountain side at a ski resort or any other recreational area. The track has a flat bottom and substantially upright sides or walls 11*a,b*. The sled includes a circular depression 13 which serves as a seat for the driver, a control handle 14, and hand grips 16 and 17. At the four corners of the sled are glide elements or pads 19, 21, 22 and 23. These are of fairly low friction material such as ultra high molecular weight or high density polyethelene. These ride on a pair of stainless steel longitudinal strips 24 and 26 which are mounted, for example, by pop rivets on the U-shaped track 11 next to the track's substantially upright retaining walls. These may be constructed of aluminum, galvanized sheet metal, stainless steel, brass, bronze, copper and any treated sheet metal. The remainder of the track section 11 can be of high strength plastic material but may also be constructed in its entirety of the same material as the strips, that is aluminum, sheet metal, etc., thereby eliminating the need for the separate distinct strips 24 and 26 shown in FIG. 2.

A pair of rectangular brake shoes 27 and 28, faced with high friction material such as rubber extend from the sides of slide 10. In front of the brake shoes are mounted a pair of low friction buffer pads 29 and 31 which extend further from the sides of the sled than the braking shoes 27 and 28 when they are in their retracted or nonextended position. This, for example, prevents contact of the brake shoes with the track sides when, for example, the sled is rounding a banked turn at a relatively low speed such that the sled might fall against the inner radius of the turn. This would occur where the driver braked excessively in the turn.

As is apparent from examination of FIG. 1, the four low friction glide pads, 19, 21, 22 and 23, located at the four corners of the sled extend transversely from the sides of the sled so that they slidably engage along with side pads 29 and 31 the sled retaining surfaces formed by sides 11*a* and 11*b* of the track. Thus, the upright side portions while serving to retain the sled on the track even in curves will not slow the sled excessively because of the arrangement of the slide elements. In other words, glide pads 19, 21, 22, 23 perform a dual function.

Figure 2:
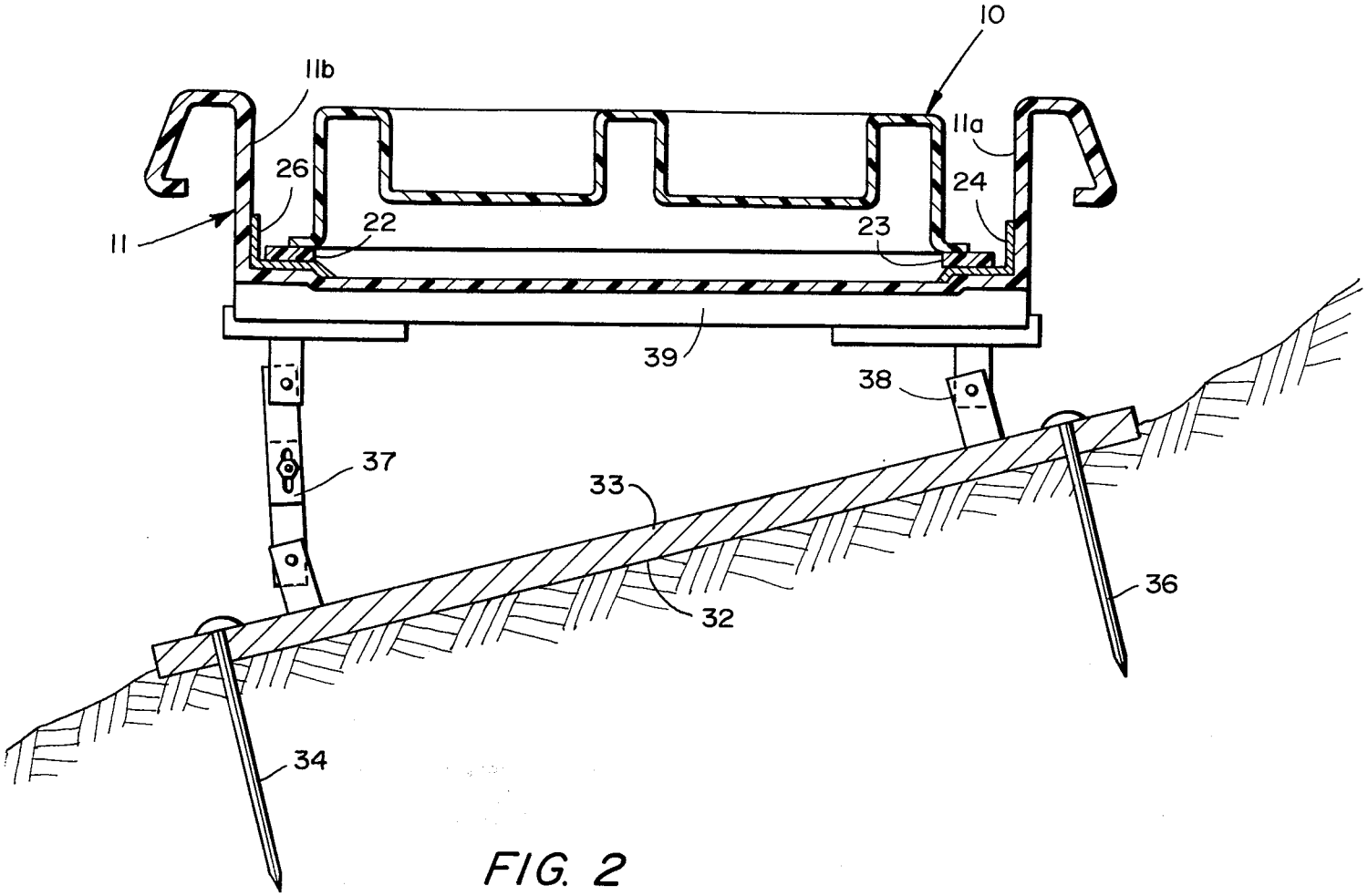
FIG. 2 is a cross sectional view substantially taken along line 2—2 of FIG. 1 showing the track section as it would be mounted on a hillside.

FIG. 2 illustrates the mounting of track section 11 on a hillside 32. Here a base support 33 is pinned in the ground by pins 34 and 36. Adjustable supports 37 and 38 then support the track section 11 on the transverse base support 39. It should be noted that the clearance of the pads 19 and 21 from the side walls 11*a* and 11*b* is about one-half inch to provide for improved linear stability.

Figure 3:
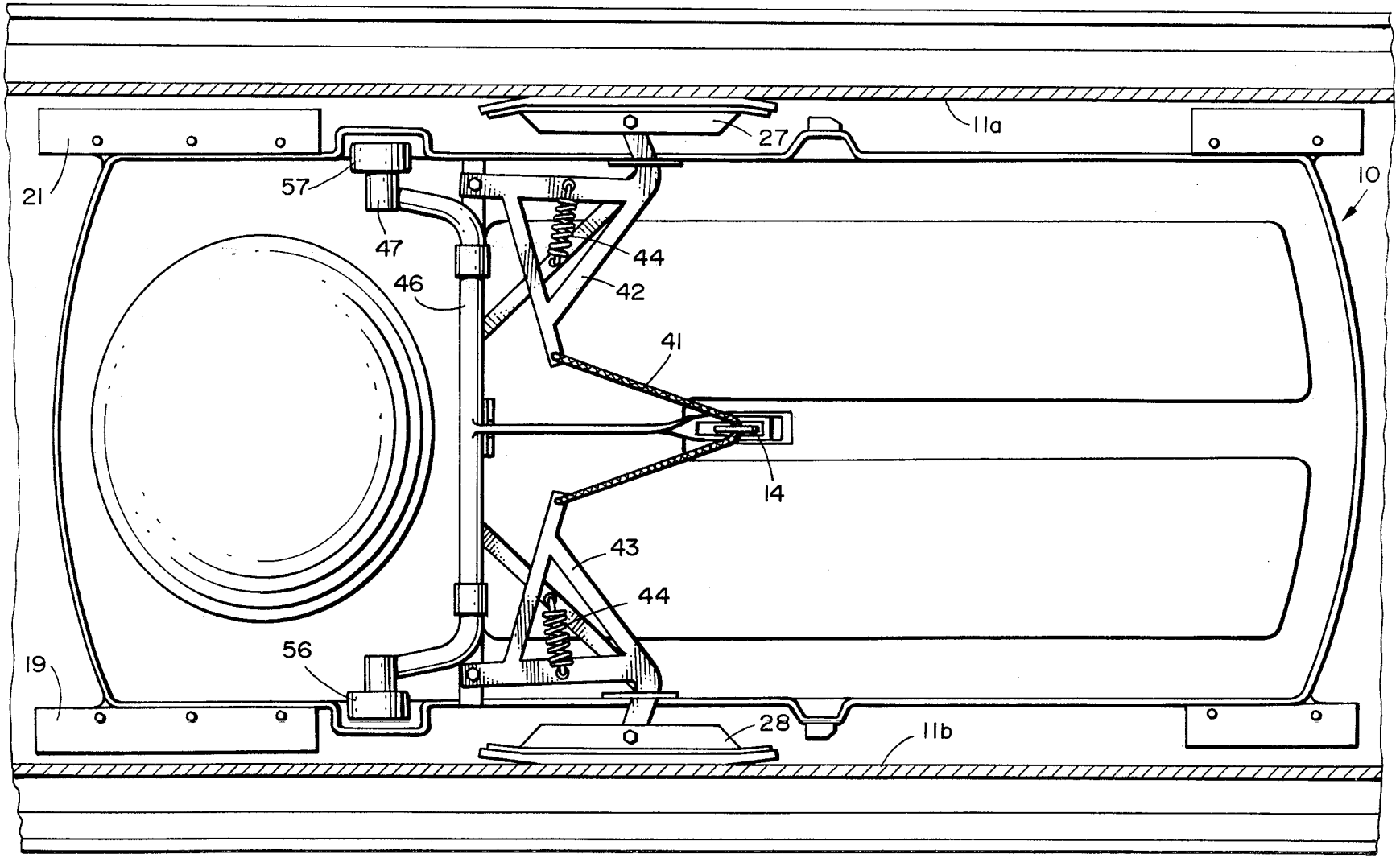
FIG. 3 is a bottom view of the track and sled of FIG. 1 also showing the brakes engaged with the upright sides of the track.

FIG. 3 is a bottom view of sled 10 illustrating its brake shoes 27 and 28 engaging wall sections 11*a* and 11*b*. This engagement occurs when the lever 14, centrally pivoted on the sled, is pulled all the way to the rear. The resultant wedging action provides superior braking. In a middle operational or neutral position of the lever the brakes are retracted, as shown in FIG. 1. In a fully forward position of the lever, a pair of wheels 56 and 57 are extended relative to the level of the rear glide elements 19 and 21 to provide for less friction and therefore greater speed down the track. The linkage system between the lever and the wheels and braking pads is relatively straight forward and can be accomplished in many different ways.

In the case of the braking system the lever is connected to a Y-shaped wire yoke 41 which is tied to pivoted triangularly shaped lever arms 42 and 43. Brakes 27 and 28 are pivotally mounted on one corner of each triangle. When the control lever 14 is moved forward as illustrated in the context of FIG. 1, for example, or is in the neutral position, the brakes because of the spring loading 44 on lever arms 42 and 43 retract. Then when the lever is pushed forward the Y-shaped wire yoke, of course, becomes slack and the lever connection 46 is engaged which rotates the offset wheel axle 47 in a direction perpendicular to the sled and track to cause the rear glide elements 19 and 21 to be lifted off the track.

Figure 4:
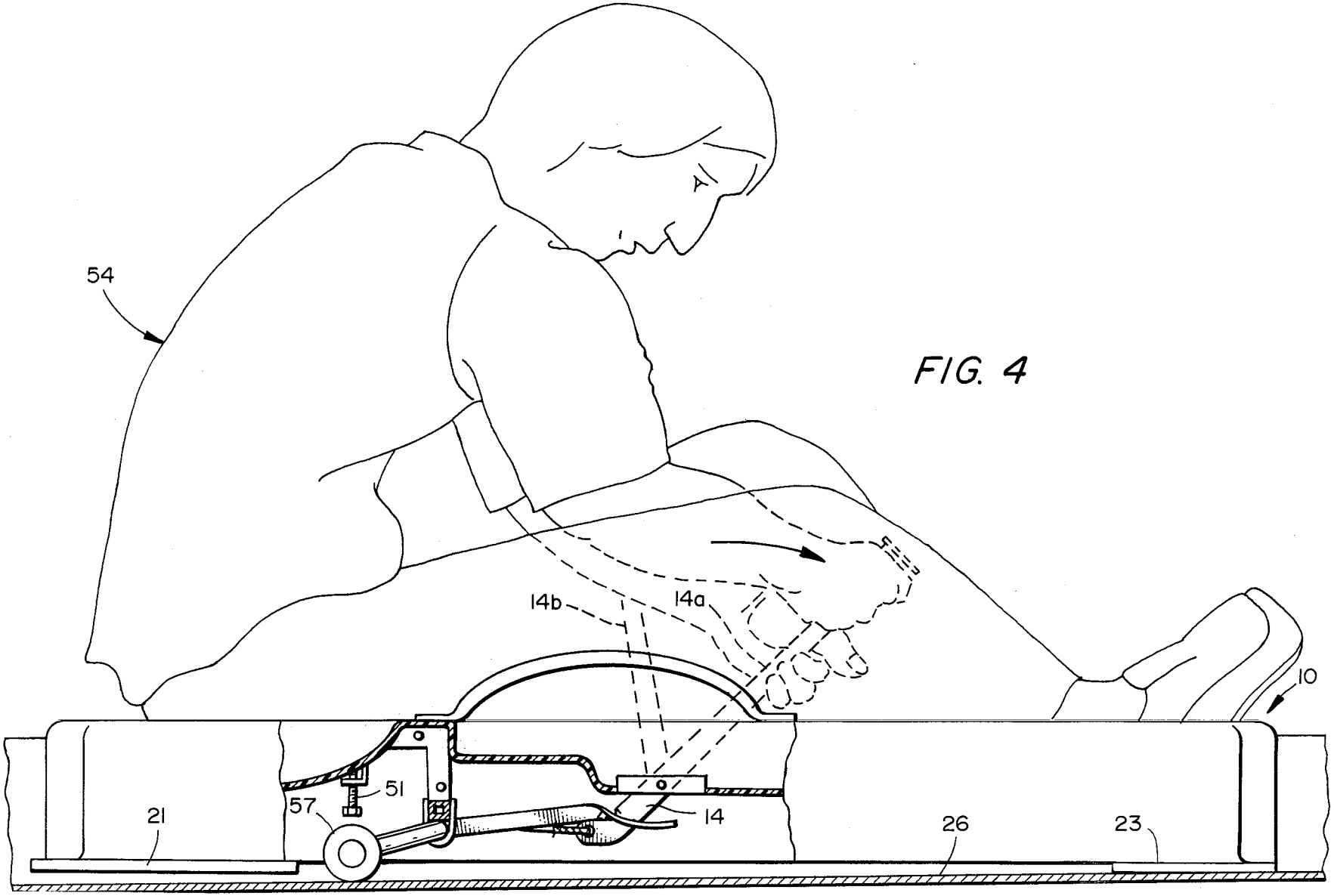
FIG. 4 is a side view of the sled with a rider or driver indicated.
Figure 5:
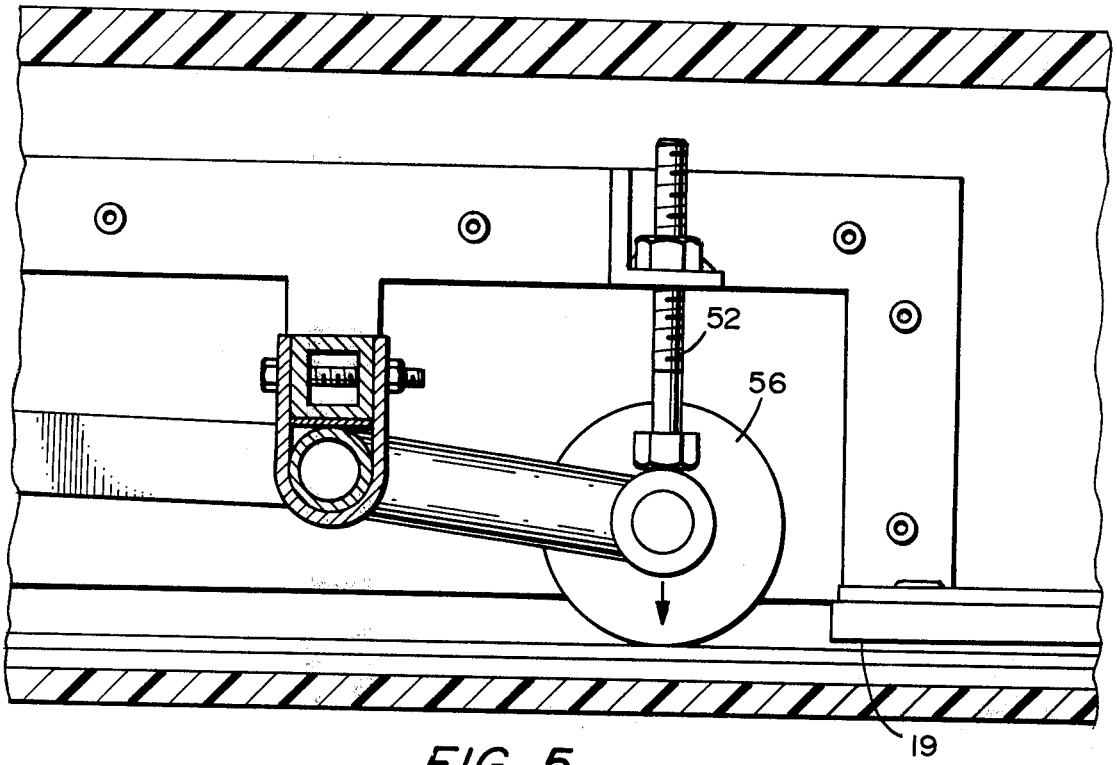
FIG. 5 is a detail view of a portion of FIG. 4 illustrating the adjustability of the wheels of the sled.

Referring now to FIGS. 4 and 5, when the wheels are nonextended, or that is the lever 14 is in its neutral position intermediate lever positions 14*a* and 14*b*, the relative position of the wheels in a direction perpendicular to the track surface or to the line of travel is controlled by a screw adjustment means 51, 52 which bear against the axle. For example, as illustrated in FIG. 5 the wheels are adjusted so as to raise the glide elements 19, 21 slightly off the track in this neutral position. This should be compared with the screw adjustment modified as in FIG. 4 to retract the wheels even more in a neutral lever position where slide elements 19 and 21 will be continuously engaged. This would be used when a mountain side was steeper and it was desired to give the driver more control by slowing the sled. Referring back to FIG. 4 it is apparent that the axis of the wheels is substantially under the center of gravity of the rider or driver designated as 54. Thus the rider may by rocking or tipping disengage the front glide pads 22, 23 for an even faster ride. Finally, with the lever 14 moved forward as shown in dashed outline 14*a*, the wheels are extended so that, irrespective of the adjustment means 51, 52, the rear glide pads are lifted. And in the pulled back position 14*b* the wheels are allowed to retract and the side brakes are applied.

One modification of the track which can be made to enhance its safety is providing narrower track strips 24 and 26 as illustrated in FIG. 1 in steeper sections of the track where a reduction of speed is desired. Since the wheels 56 and 57 are spaced closer together then the glide pads they will be out of engagement with the glide strips 24 and 26 while at least a portion of the pads are still sliding on the strips. Moreover, in these track portions the strips can be made of material with a higher coefficient of friction as, for example, wood.

Thus, in summary the sledding system of the present invention provides for a great degree of control and therefore safety while at the same time having a greater degree of adjustability for a more interesting ride down the mountain side.

What is claimed is:

1. A sledding system comprising: a track including a plurality of joined U-shaped sections and defining a path for a sled, the bight of said U-shaped section providing a substantially flat sledding surface and the substantially upright sides of said U-shaped section providing a common pair of sled retaining and braking surfaces; and at least one sled including dual function, unitary glide elements, each said glide element engaging both said sledding surface and said common pair of surfaces and also including selectively engageable braking means for retaining and guiding extendable from the sides of said sled for frictionally engaging said common surfaces in a wedging manner for braking said sled.

2. A sledding system as in claim 1 where said sled includes a seat for receiving a driver and only a single pair of wheels, for rolling on said track, located substantially under said seat whereby the center of gravity of said driver is substantially aligned with the axis of said pair of wheels.

3. A sledding system as in claim 1 where said glide elements includes four low friction pads mounted at the corners of said sled and transversely extending therefrom relative to the sides of said sled to slidably engage said pair of sled retaining surfaces of said track.

4. A sledding system as in claim 3 where said sled includes a pair of wheels in addition to said glide elements for selectively engaging said track said wheels being spaced closer to each other along their axis relative to the spacing of said glide elements.

5. A sledding system as in claim 2 where all of said track sections include spaced longitudinal strips of low friction material on which glide elements slide but where at least one of said track sections has strips which are narrowed to avoid contact with said wheels.

6. A sledding system as in claim 3 including an additional pair of low friction pads fastened to the sides of said sled so that low friction contact with the inner sled retaining surface in a banked curve is provided when a sled is travelling at a low speed relative to said banking of said curve.

7. A sledding system as in claim 10 where said additional pair of pads extend further from the sides of said sled than said nonextended braking means.

8. A sledding system as in claim 1 where said track sections include spaced longitudinal strips of low friction material on which said glide elements of said sled slide.

9. A sledding system as in claim 1 where said sled includes a pair of wheels in addition to said glide elements for selectively engaging said track said wheels having an extended and retracted position; and adjustment means for positioning said wheels relative to a pair of said glide elements, while in the retracted position, in a direction perpendicular to the track surface whereby the sliding engagement of said pair of glide elements with said track is controlled.

10. A sledding system as in claim 9 where said adjustment corresponds to the grade of said track, on shallow grades said glide elements are substantially out of sliding engagement and on steeper grades said wheels are substantially disengaged from said track and said glide elements are fully engaged.

11. A sledding system as in claim 1 where said braking means is actuated by a pivoted handle on said sled.

12. A sledding system as in claim 11 wherein said gliding elements are located at the front and back ends of said sled and wherein said sled includes a wheel arrangement actuated by a pivoted handle on said sled for lifting the back glide elements of said sled.

* * * * *